United States Patent [19]

LaVigne

[11] 4,451,357

[45] May 29, 1984

[54] APPARATUS FOR DRY PLACER MINING AND METHOD OF OPERATING SAME

[76] Inventor: Gordon LaVigne, Box 153 Tiger Star Rt., Colville, Wash. 99114

[21] Appl. No.: 379,190

[22] Filed: May 17, 1982

[51] Int. Cl.[3] ..... B03C 7/08

[52] U.S. Cl. ..... 209/131; 209/470

[58] Field of Search ..... 209/470, 471, 472, 129, 209/131, 485, 486, 822, 820; 198/698, 848

[56] References Cited

U.S. PATENT DOCUMENTS

| | | | |
|---|---|---|---|
| 344,720 | 6/1886 | Carpenter | 209/131 |
| 529,340 | 11/1894 | Watson | 209/470 |
| 714,257 | 11/1902 | Sutton et al. | 209/470 |
| 719,397 | 1/1903 | Waugh | 209/470 |
| 830,538 | 9/1906 | Stebbins | 209/470 |
| 1,083,172 | 12/1913 | Winnie et al. | 209/131 |
| 2,116,613 | 5/1938 | Bedford | 209/470 |
| 2,144,671 | 1/1939 | Adams | 209/470 |
| 2,299,298 | 10/1942 | Bignell | 209/470 |
| 2,689,648 | 9/1954 | Maestas | 209/131 |
| 2,769,531 | 11/1956 | Gaba | 198/848 |
| 2,864,501 | 12/1958 | Bolander | 209/470 |
| 3,096,277 | 7/1963 | Maestas | 209/131 |
| 3,233,720 | 2/1966 | Jorgensen | 198/822 |
| 3,773,174 | 11/1973 | Stimpel | 209/131 |
| 3,799,334 | 3/1974 | Collins | 209/470 |

*Primary Examiner*—F. W. Lutter
*Assistant Examiner*—William Bond
*Attorney, Agent, or Firm*—Hughes, Barnard & Cassidy

[57] ABSTRACT

An apparatus for dry placer mining to concentrate recoverable metallic constituents, such as gold or silver, from a dry gravel mix containing same is comprised of a frame for supporting and guiding an endless belt along a path including an upwardly inclined segment for receiving gravel particulate; an endless belt including a woven mesh belt member, a plurality of riffle members disposed in spaced parallel relationship within the intertices of the mesh member, and a composite fabric member disposed in face-to-face contact with the bottom surface of the mesh member; and a fluidizing member for passing a fluidizing gas upwardly through the endless belt along the inclined segment for fluidizing the gravel particulate and for establishing an electrostatic charge proximate the riffle members. The composite fabric member is specially constructed to permit a proper airflow for fluidizing the particulate and for assisting in the establishment of an electrostatic potential proximate the riffle members. This special construction includes a layer of an air-pervious polymeric foam disposed intermediate a pair of cloth fabric layers having progressively tighter weave patterns.

18 Claims, 10 Drawing Figures

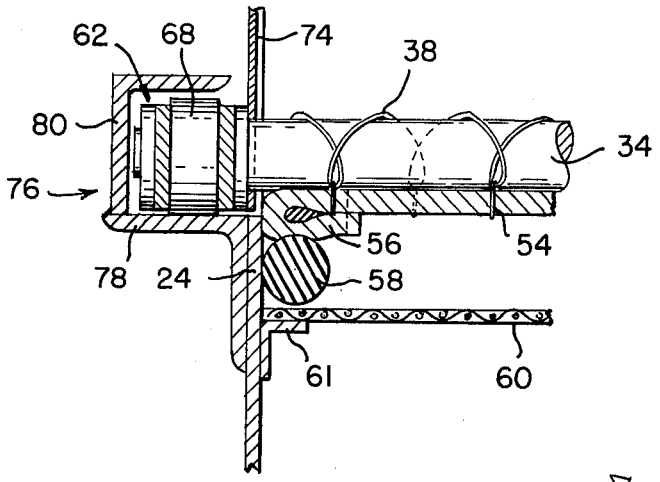
FIG. 6
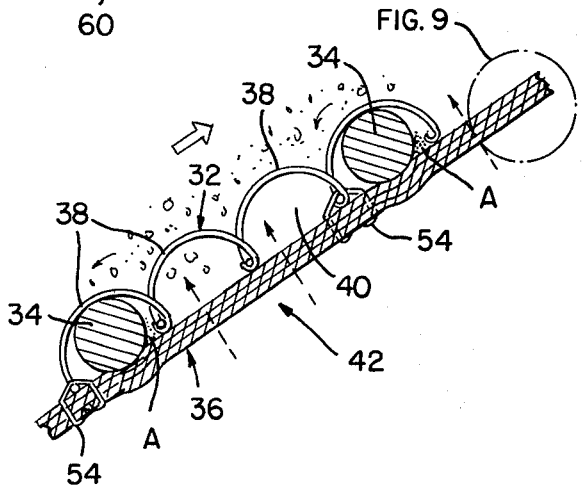
FIG. 7
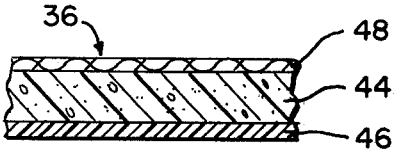
FIG. 9
FIG. 8
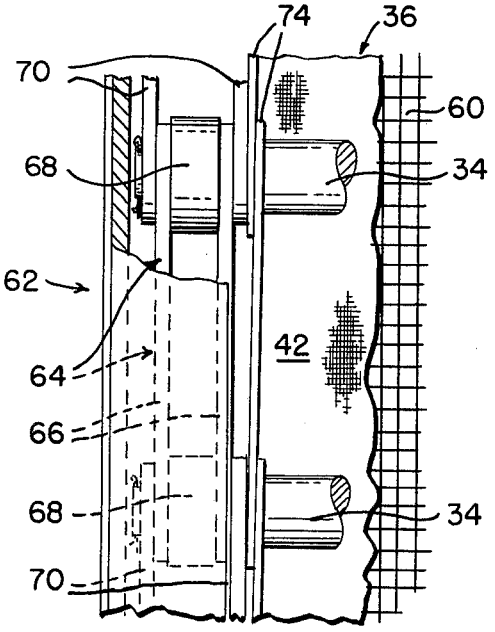
FIG. 10
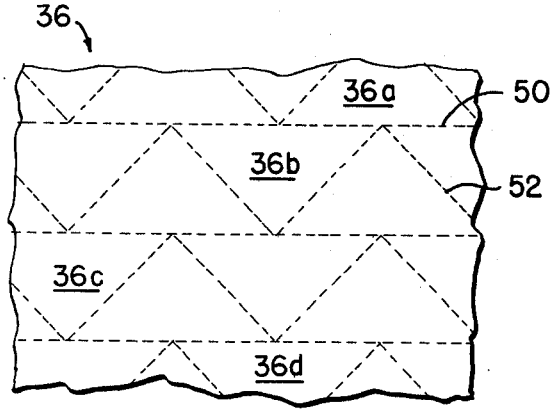

APPARATUS FOR DRY PLACER MINING AND METHOD OF OPERATING SAME

BACKGROUND OF THE INVENTION

1. Field of the Invention

The present invention relates, generally, to apparatus for dry placer mining and, more especially, to such apparatus which are capable of concentrating recoverable metallic products from gravel particulate wherein the separatory effects are the consequence of carefully controlled fluidization of the gravel and electrostatic retention of the metallic constituent on a moving belt.

2. Description of the Background Art

Dry placer mining, particularly including the mining of gold and/or silver materials from gravel particulate, has been known for many years. A number of approaches have been suggested in the past respecting the design of an efficient apparatus for this purpose. These apparatus may be roughly categorized into three groups: viz., (i) those which employ a moving, perforate or foraminous belt through which air is blown to effect a separation of the lighter-weight materials; (ii) those which use a perforate or foraminous belt which is either vibrated for separation or through which a pulsating air blast is directed; and, (iii) those which employ magnetic or electric field effects to achieve separation.

U.S. Pat. Nos. 2,144,671, 830,538, and 529,340 are generally typical of the devices falling into the first category mentioned above. For example, the '671 patent discloses an upwardly traveling belt comprising a perforate support member consisting of a wire mesh screen and a layer of finely woven fabric, such as airplane linen. The fabric lies on the upper surface of the screen and is secured thereto by means of laterally-directed riffle bars. Air is directed both upwardly through the belt to cause separation between the lighter and heavier components and also over the top of the belt in a downwardly extending direction generally parallel to the length of the belt in order to classify the materials. The '538 patent is conceptually similar insofar as it employs a foraminous belt. It is different in an important aspect, as the construction is designed to insure that the air passes through the belt openings at an angle with an upward slant over the length of the belt. The '340 patent also discloses a device where air is directed through a perforate belt; and is further remarkable for the fact that the same includes magnets placed immediately beneath the upper part of that belt.

U.S. Pat. Nos. 3,799,334, 2,864,501, 2,299,298, 719,397, and 714,257 are representative of the second category mentioned above. For example, the '334 patent teaches a process where bulk material is first passed through an oven and then a so-called "air-float" concentrator. The upper, particle-carrying portion of the belt travels in a downhill direction while being pulsed by an air supply. It is asserted that gold will collect against the riffle bars. The '501 patent shows a belt having a cloth upper layer and a screen mesh/cloth lower layer, and one further including riffles. The belt travels upwardly and a bellows causes pulsing air to flow through it. The '298 patent shows a perforate belt through which air is directed in an upward direction while the belt itself is vibrated. The '397 patent discloses a machine where a traveling belt is maintained in a substantially horizontal position. There are magnets beneath the belt, as was the case in the '340 patent mentioned above in Group I, and air is directed through the belt while it is vibrated. The patentee states that three forces act upon the metallic particles for separation, namely vibratory force, air force, and magnetic force. The '257 patent is conceptually similar to these other Group II patents, insofar as it teaches a perforate belt through which air is pulsed by means of a bellows.

U.S. Pat. Nos. 3,773,174, 3,096,277, 2,689,648, 2,116,613, 1,083,172, and 344,720 exemplify those devices falling within the ambit of the third group mentioned above. The '174 patent teaches a separatory process wherein a stationary fabric layer is provided with an upwardly directed airflow. The air agitates particles on the fabric and metallic particles are held by the creation of an electrostatic charge on the cloth. The '277 patent discloses a rather different arrangement where particles on a belt are exposed to an alternating electrical field. Air is blown laterally over the top surface of the belt to move the less dense and segregated material. The '648 patent shows a horizontally disposed traveling belt on which material for separation is placed. Again, an alternating electric field is used to segregate the metallic constituents. It appears that this apparatus does not utilize air as part of the separatory technique. The '613 patent teaches a stationary screen which is electrostatically charged while air is blown upwardly through it. The '172 patent shows a vibrating belt which is placed in a high voltage electric field to effect separation of metallic particles. The '720 patent discloses an upwardly positioned and charged belt designed to pick up light material. Air passes upwardly through the bottom part of the machine toward this charged belt.

As can be appreciated from the foregoing discussion, all variety of apparatus and methods have heretofore been proposed for dry placer mining with the goal of separating valuable constituents such as gold or silver from a gravel particulate. Many of the designs incorporated in the aforementioned patents are extremely complex. Others are extremely sensitive to ambient conditions, including the condition of the material to be treated. Some are not terribly effective in achieving the destined objective of concentrating the valuable components within the feed. Yet others demand rather close attention by operators during the charging steps, the intermittent cleaning and recovery steps required by some designs, and the control of process parameters.

Accordingly, the need exists to provide an improved apparatus for dry placer mining, which is simple yet highly efficient in use, durable, and which requires only limited attention during operation. The need also exists to provide such a device which exhibits portable mobility so that it may conveniently be moved from location to location as the need arises or is desirable.

SUMMARY OF THE INVENTION

The present invention advantageously provides an improved apparatus for dry placer mining which efficiently and yet simply concentrates the recoverable metallic product from gravel particulate containing same. The present invention is further desirable for its portable mobility which is achieved without sacrificing durability in use. The present invention provides the further advantage of effectuating the separatory recovery without the need for more than minimal human supervision over the process.

The foregoing and other advantages of the present invention are provided by an apparatus comprising a frame for supporting and guiding an endless belt along a path including an upwardly inclined segment for receiving a gravel particulate mix; an endless belt means having a longitudinal axis along the direction of motion and a transverse axis generally perpendicular thereto, wherein the belt means includes a woven mesh belt member having a plurality of intertices, a plurality of riffle members disposed in spaced, parallel relationship within the interstices, and a composite fabric member disposed in face-to-face contact with the bottom surface of the mesh member; and fluidizing means for passing a fluidizing gas upwardly through the endless belt means along the inclined segment for both fluidizing the gravel particulate and for establishing an electrostatic charge proximate the riffle members. The composite fabric is specially constructed to provide an optimum flow of fluidizing gas and to assist in the establishment of the electrostatic field. In a preferred form of the invention, the composite fabric is comprised of a layer of air-pervious polymeric foam disposed intermediate upper and lower cloth fabric layers. In the most preferred form of the invention, the bottom cloth layer is one having a coarse weave, most preferably a polyester batting made from Orlon fiber, and the upper layer is a tighter weave broadcloth, preferably one of a cotton/polyester blend.

A plenum is included intermediate the upper and lower runs of the closed path of the endless belt. A fan charges the plenum and a series of baffles provide a directed airflow through a screen and into contact with the coarse woven, bottom layer of the composite fabric. The air then is driven through the foam and thence through the tighter weave into the area of the endless belt. Gravel containing material to be removed is charged near the upper reach of the moving belt and tumbles downwardly as the fluidizing gas separates lighter from heavier particulate. The combined effect of fluidizing turbulence, moving particulate, and passage of the gas through the belt components creates an effective electrostatic charge proximate the riffle members, which charge serves to retain gold, silver, or like materials while the remaining gravel and sand is discharged along a downwardly extending path.

Under some circumstances it may be found necessary or desirable to augment the naturally-occurring electrostatic field existing in the apparatus. In such a case, there is optionally but preferably provided an electrostatic charge generator for that purpose.

Material to be treated may be continuously charged to the moving belt. Recovered material may continuously be removed and the remaining gravel/sand continuously discharged. Accordingly, little intervention for cleaning and/or recovery of concentrated product is required.

In a most preferred form of the invention, the entire apparatus is supported on a frame secured to a base by at least one hydraulic cylinder. The cylinder may be activated to incline the belt at the desired orientation for use or to collapse the apparatus for ease of transportation.

Other advantages, and a fuller appreciation of the structure and utility of the present invention, will be gained upon an examination of the detailed description of the invention, taken in conjunction with the figures of drawing, wherein:

BRIEF DESCRIPTION OF THE DRAWINGS

FIG. 6 is an enlarged, fragmentary sectional view taken substantially along the line 6—6 of FIG. 3;

FIG. 7 is an enlarged sectional view taken substantially along the line 7—7 of FIG. 5;

FIG. 8 is an enlarged, fragmentary sectional view taken substantially along the line 8—8 of FIG. 4;

FIG. 9 is an enlarged, fragmentary sectional view taken substantially along the line 9—9 of FIG. 7; and, FIG. 10 is a bottom plan view of the composite web of FIG. 9.

DETAILED DESCRIPTION OF THE INVENTION

The present invention relates generally to apparatus for dry placer mining and, more especially, to such apparatus wherein separation of valuable, metallic products such as gold or silver from gravel particulate containing same is effectuated under the combined influences of fluidization of the gravel and electrostatic retention of the metallic product on a travelling separation belt. Accordingly, the invention will now be described with reference to certain preferred embodiments within the aforementioned context; although those skilled in the art will fully appreciate that such a description is meant to be exemplary only and should not be deemed limitative.

Figure 1:
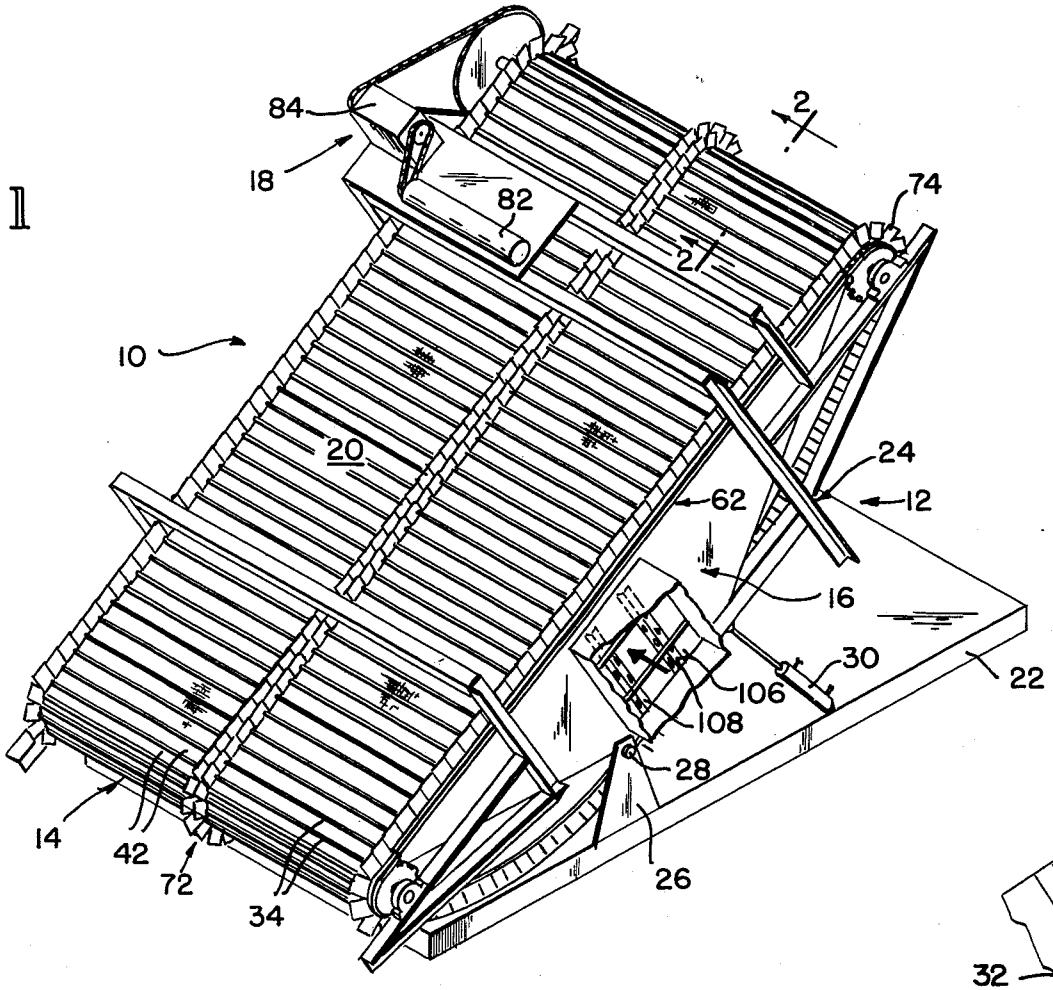
FIG. 1 is an isometric view, with parts broken away, of an apparatus in accordance with the present invention.

Turning to the figures of drawing, in all of which like parts are identified with like reference numerals, a dry placer mining apparatus, designated generally as 10, is shown in FIG. 1 to be comprised of a frame 12 which supports and guides an endless separation belt means 14 about a generally trapazoidal, closed path surrounding a fluidization means designated generally as 16. The separation belt 14 is caused to traverse the closed path by means of a drive system, designated generally as 18. As the belt moves about its path, ore or a particulate gravel mix containing metallic constituents to be removed or concentrated is charged to the upper face of apparatus 10 along an upwardly inclined segment of the trapazoidal path, designated 20 in FIGS. 1 and 5, while fluidization gas is passed upwardly from the fluidization means 16 through the separation belt 14. As the belt moves upwardly along the inclined path, as represented by the arrow in FIG. 5, the gravel and sand components of the charge are fluidized by the gas passing through the belt. During this fluidization, and as a consequence of the structure of the belt 14 and its relationship to the fluidization means 16, an electrostatic charge is developed proximate the separation belt 14. As the result of combined fluidization of gravel along with the electrostatic charge developed on or proximate the belt 14, the metallic constituents are retained on the separation belt 14 while the gravel is fluidized and flows downwardly across the belt. The product recovered is thereby enriched or concentrated in the relative proportion of metallic constituents vis-a-vis the original gravel. The concentrate, which includes heavy or dark sands, may then receive a further or final refining treatment.

Figure 5:
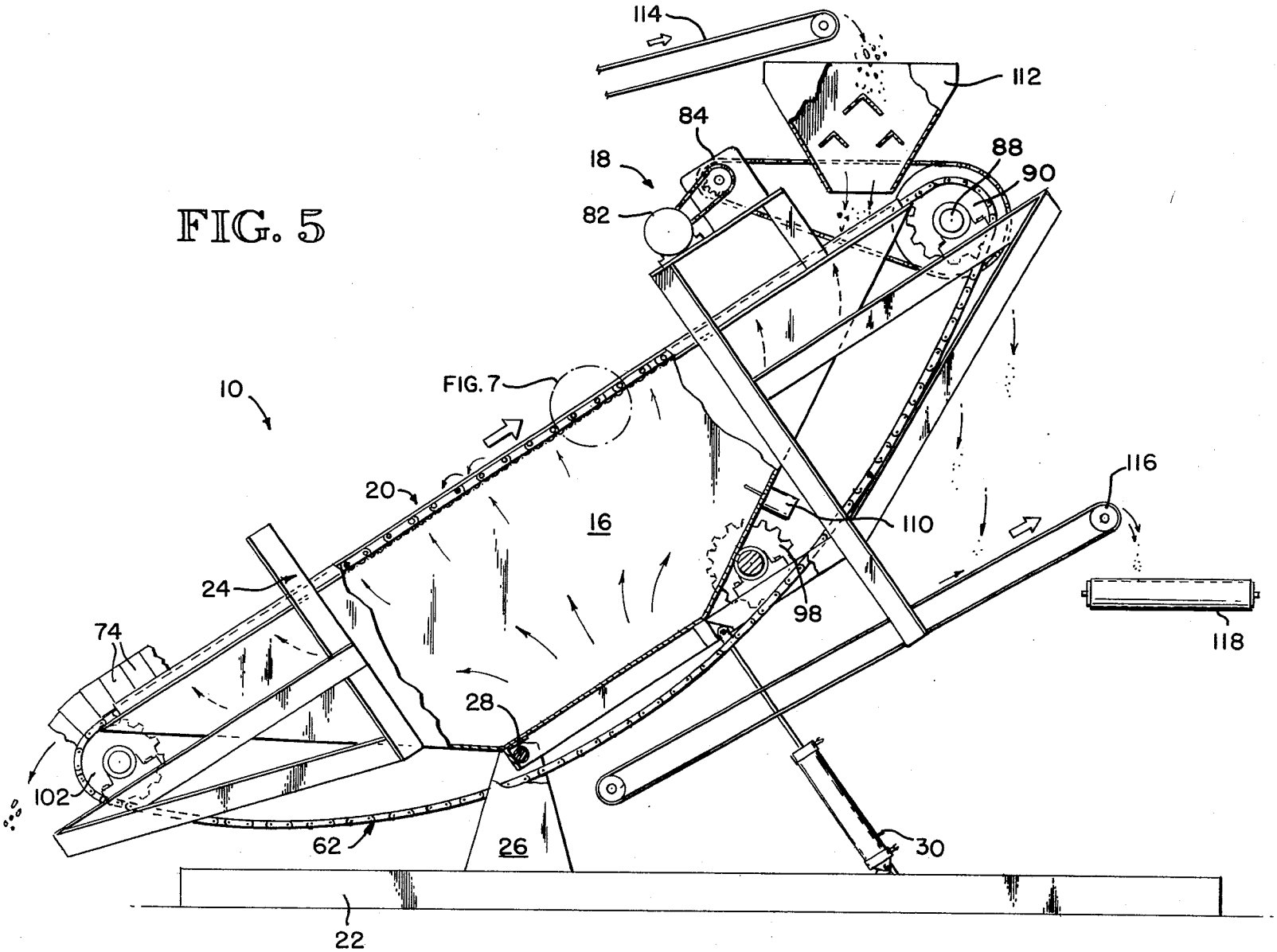
FIG. 5 is a sectional, side elevational view of the apparatus shown in FIGS. 3 and 4.

Since the apparatus 10 is envisioned for use typically in relatively remote locations, portable mobility and ease of erection from a transportation configuration to an operation configuration are very desirable features. Thus, the frame or support means 12 is comprised of a base plate 22 to provide a solid foundation for the apparatus 10 and an upper frame structure designated generally as 24 pivotally received on the plate. The plate 22 includes a pair of stanchion members 26 supporting the upper frame 24 about pivot pins 28 so that the frame 24 and associated portion of the apparatus 10 may pivot from a transportation configuration, where the face 20 is in a generally horizontal orientation, to an operational configuration as shown in FIGS. 1 and 5, where that portion is inclined with respect to the horizontal. Any convenient means for applying a pivoting force on the upper frame 24 to achieve this purpose may be employed; the preferred embodiment illustrated in the figures of drawing showing hydraulic cylinder means 30 to achieve this goal. Whatever means are used to apply the pivoting force to the frame 24, it is highly desirable that the same be capable of providing an adjustable angle of inclination to the upper face 20 of the moving belt 14 since this angle is a important factor in establishing the residence time of the gravel on the belt 14 during the separatory process.

The construction of the separatory belt 14 is of manifest importance to the efficiency of separation of the metallic constituents from the gravel charge. FIGS. 6–10 illustrate the most preferred construction of belt 14, which has been found to be most efficient in terms of its ability to support the load of material charged to the apparatus for separation and provide a high degree of recovery while exhibiting good durability and reliability in use. In this most preferred construction, the belt 14 is comprised of three components, namely a woven mesh belt or web member designated generally as 32, a plurality of round riffle members designated generally as 34, and a fabric designated generally as 36.

The woven mesh belt member 32 is preferably a steel mesh web comprised of a series of intersecting, upstanding loop elements 38 having a closed configuration to yield interstices 40 through which the riffle members 34 may be passed to provide the overall configuration shown, for example, in FIG. 1. Most preferably, the dimensioning of the interstices 40 and riffles 34 is correlated so that a relatively tight fit between the two results. As best viewed in FIG. 7, the riffles are disposed through the pattern of interstices 40 periodically along the length of the mesh web 32 so that a plurality of transverse collection zones 42 are established along the belt 14 between successive riffle members. The recoverable product will be found to collect within the zones 42 and particularly adjacent the upstream side of the riffles 34, as described in somewhat greater detail below. Accordingly, while the pattern of the riffles 34 through the interstices 40 may vary somewhat, thus varying the dimension of the collection zones 42, it is generally desirable that the riffles be separated by a sufficient distance to provide for good retention of product within the zones 42 but not so far apart as to curtail the ability to include as many riffles as is reasonably possible, since the amount of recovery will be reduced as the number of riffles themselves are reduced. A preferred relationship is shown in detail in FIG. 7, where two successive riffles are separated by two series of loops 38. Staggering the riffles closer together, with only one intervening loop, will tend to crowd the collection zone 42 and may tend to reduce the recovery of product because of less efficient fluidization through the belt. On the other hand, staggering the riffles to provide more than about eight sets of loops intermediate successive riffle members likewise will tend to reduce the recovery as there become fewer mechanical obstructions for retention of the separated metallic constituents. Accordingly, the general range will be from about two to about six intervening series of loops for best operational efficiencies; from two to four intervening loops being found most efficient. By way of example, in order simply to illustrate one construction found to perform quite well, a belt was constructed to provide a gravel processing segment (corresponding to segment 20) about twelve feet long and seven feet wide. The belt included a mesh web of interpenetrating helical steel loops where the transverse inner dimension of each loop was about ¾". Riffles of ⅝" diameter steel rods were disposed through the mesh, with a separation to yield a collection zone of about 3½".

The fabric 36 comprising the last essential element of the separation belt structure is one specially designed to optimize the conditions contributing to separation. This fabric, best viewed in FIG. 9, is a composite fabric member comprised of an intermediate layer 44 of an air-pervious polymeric foam, preferably a polyester foam, and most preferably a 60 PPI polyester foam, sandwiched intermediate a lower fabric layer 46 and an upper cloth fabric layer 48. The lower layer 46 is preferably made from a synthetic fiber fabric or batting having a fairly open weave, and most preferably a coarse woven polyester batting of fibers such as those sold under the name "Orlon". Conversely, the upper fabric layer 48 is preferably one with a relatively fine weave and most preferably a cotton/polyester blend broadcloth having about 200 threads per inch. Consequently, the composite fabric 36 presents a gradient in the pore size or dimensions of the air passageways from bottom to top, corresponding to the direction of fluidization gas through the belt 14.

The foregoing most preferred construction for the composite fabric 36 is one which has been determined empirically to provide very good air-flow characteristics while maximizing the electrostatic charge which is a principal factor in the efficiency of separation of the metallic constituents from the gravel charge. When subjected to a fluidization air flow with a variable static pressure averaging about 6.2 psig of dry air, a turbulent air flow within the mix is established imparting a charge attracting the metallic constituents to the riffles. The composite fabric, and particularly the foamed polymer layer, has been found to increase the ability of the fluidization air to impart this charge; while the overall structural configuration of the belt 14 has been seen to yield an oval turbulence pattern within the mix due to the belt weave, thereby creating an alternating field twisting the dipoles in one direction and causing an energy loss, all of which results in hysteresis and retention of the metallic particles on the belt 14.

The components of the belt 14, due to the preferred construction noted above, are very easily assembled into a unitary and cooperative structure. Preferably, the components of the composite fabric 36 are stitched together and most preferably in the stitching pattern shown in FIG. 10. That pattern includes a first series of stitching lines 50 extending transversely across the fabric and dividing it into a plurality of transverse panels **36*a*, 36*b*, 36*c*, 36*d*, etc. Each panel is shown to be of a generally rectangular shape, through which passes a zig-zag sawtooth stitching pattern 52 where the apices of that sawtooth pattern point in the direction of travel of the belt 14 along its longitudinal axis. This stitching pattern has been found to be optimum in terms of securing the components together, providing good strength to the fabric which must share in the support of substantial loads on the separation belt 14**, and one which permits for good fluidization characteristics as the fluidization gas passes first through the composite fabric before creating the turbulent air flow separating gravel from metallic components.

The mesh web 38 is secured vis-a-vis the riffles by virtue of the closed loop pattern through which the riffle members pass. The composite fabric 36 is most easily secured in place by fastening means between the fabric and the mesh web, such as by staples 54 as viewed in FIGS. 6 and 7. It is also preferred that the edges of the composite fabric be folded and sewn to provide at least a double thickness edge 56, best viewed in FIG. 6, abutting the frame 24. This will not only prevent the edges from fraying, but will serve as a type of seal preventing particulate material from dropping beneath the moving belt 14 and entering the fluidization chamber 16. Insofar as continual use of the apparatus 10 will in most instances begin to wear this edge, a second seal means 58 is preferably disposed beneath the double fold 56 along at least the full extent of the inclined path 20, again to minimize the tendency for any particulate to drop within the fluidization chamber 16. As a further measure of safety along these lines, a screen 60 preferably extends beneath the entire extent of the belt 14, being secured at opposed ends to the frame 24, e.g., by means of angle brackets 61. Not only will the screen 60 guard against material dropping within the fluidization chamber 16, it has been found that the screen will help directionalize the fluidization gas delivered from the fluidization means to the belt and also assist in providing a uniform distribution of that fluidization medium.

The belt 14 is specially designed to provide integral drive chain means 62 for cooperative, operational engagement with the drive means 18 in order to move the belt about its closed path. Preferably, each edge of the belt 14 includes such an integral drive chain where each chain is itself comprised of a series of links 64, one of which is shown in detail in FIG. 8.

The link 64 is comprised of a pair of connecting bars 66 which join the terminal ends of successive riffle members 34 together. Preferably, the connecting bars are simply short metal plates having apertures pierced or holes drilled therein corresponding to the diameter of the riffle bars. A roller member 68 is disposed on each riffle 34 intermediate the connecting bars 66. Preferably, the roller member 68 is free to turn relative to the riffle member and, accordingly, might be a bearing member or a short cylindrical member having an inner diameter only slightly greater than the outer diameter of the riffle to accommodate a sleeve or insert of a low-friction material. However, while the ability of the roller members 68 to rotate is a desirable one, it is not essential to the overall operation of the mining apparatus 10. As can be seen in FIG. 8, a second set of partially overlapping connecting bars, identified as 70, are also borne on each riffle member. These bars 70 extend to the next adjacent riffle members to comprise the next successive links in either direction from that shown in the figure. In turn, each of those adjacent riffles will further include another set of connecting bars joining the same with the next adjacent riffle. The components comprising the link may be secured in place on each riffle in any convenient manner. Most preferred, for simplicity and yet reliability, is a conventional cotter key at the end of each riffle outwardly proximate the connecting bars 70 to hold them against movement in an outward direction while the inner side is prevented from movement by the edge of the belt 14.

The drive chain means are preferably integral with each edge of the belt 10 so that the driving force can be applied more uniformly across the belt than would be the case if it were driven from one side only. More preferable yet is the inclusion of a third drive chain means 72 disposed intermediate the width of belt 14. The intermediate drive chain 72 includes a series of links essentially identical to the links 64 described in detail above. That is, each link includes a pair of connecting bars extending between two successive riffle members, which bars are themselves separated transversely by roller members. In order to maintain the positioning of the links comprising the intermediate chain 72, the mesh web 32 is preferably divided into two segments as best viewed in FIGS. 1, 3 and 4. Thus, a first segment of the mesh web 32 extends from the first edge chain to the one side of the intermediate chain 72 and the second segment of the mesh web extends from the second edge chain to the other side of the intermediate chain 72.

Figure 2:
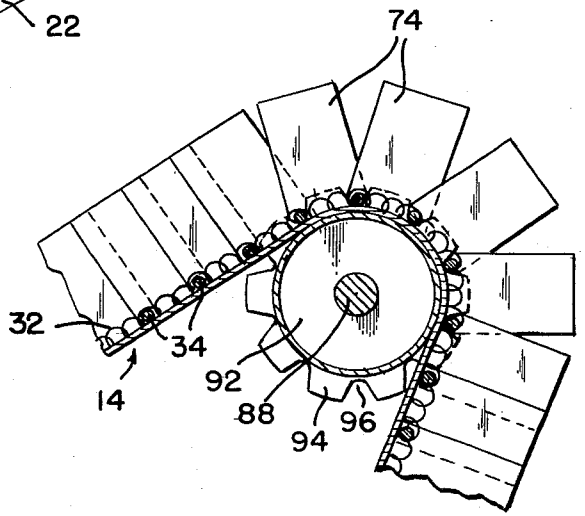
FIG. 2 is an enlarged, fragmentary sectional view taken substantially along the line 2—2 of FIG. 1.

The separation belt 14 is preferably provided with edge guards to confine the path of travel of the gravel as it progresses downwardly across the belt during the separation process, guarding against spillage off the edges; and, where the belt is divided as shown in the figures of drawing, through the area proximate the intermediate chain 72. For this purpose, the belt includes a plurality of upstanding edge guard plates 74, best viewed in FIGS. 1 and 2. Each of these plates is preferably a thin metal plate formed, e.g., from sheet metal. Each plate is pierced along its lower edge with a hole near each corner so that the plate may be received between two successive riffle members. The plates 74 disposed along the outside edges of the belt 14 are preferably sandwiched between the edges of the mesh web 32 and the connecting bars 70, as best viewed in FIG. 8. Those proximate the intermediate drive chain 72 are likewise sandwiched between the connecting bars and respective edges of the segmented mesh web 32, as generally indicated in FIG. 2.

The overall assembly of the belt 14 is very simple but nonetheless yields a highly durable component. The riffles are first fitted with the connecting bars and roller members comprising the intermediate drive chain 72. The corresponding guard plates 74 are then disposed over the riffles with each plate spanning the gap between two successive members, as shown generally in FIG. 2. Next, the segmented mesh web 32 is disposed upon the riffle members from either side thereof, with the riffles passing through the channels of interstices 40 to retain the mesh web in place. The edge guard plates 74 are then added at either end in the same type of partially overlapping engagement where one plate spans two successive riffles. Subsequently, the connecting bars and roller members are added to form the links detailed in FIG. 8. Lastly, each end of the riffles is then provided with some means to secure the outer connecting bars 70, such as a cotter key. With the belt in that configuration, the composite fabric 36 is attached by stapling the same to the mesh web 32 entirely across the inside bottom face of the belt 14.

The belt 14 is supported for and guided during movement about its closed path by means of a track member 76, best viewed in FIG. 6, secured to the support frame 24. For ease of construction, the track member 76 is comprised of a pair of angle members 78 and 80 in the form shown in FIG. 6 to yield an inwardly directed slot for receiving the terminal edges of the belt 14. In the preferred embodiment shown, the roller members 68 comprising the drive chain links ride on the upper face within the track 76, and it is for this reason that the roller members most preferably are capable of rotational motion vis-a-vis the individual riffles to minimize the drag on the belt, which can become very significant when the same is charged with a load of gravel for separation.

Figure 3:
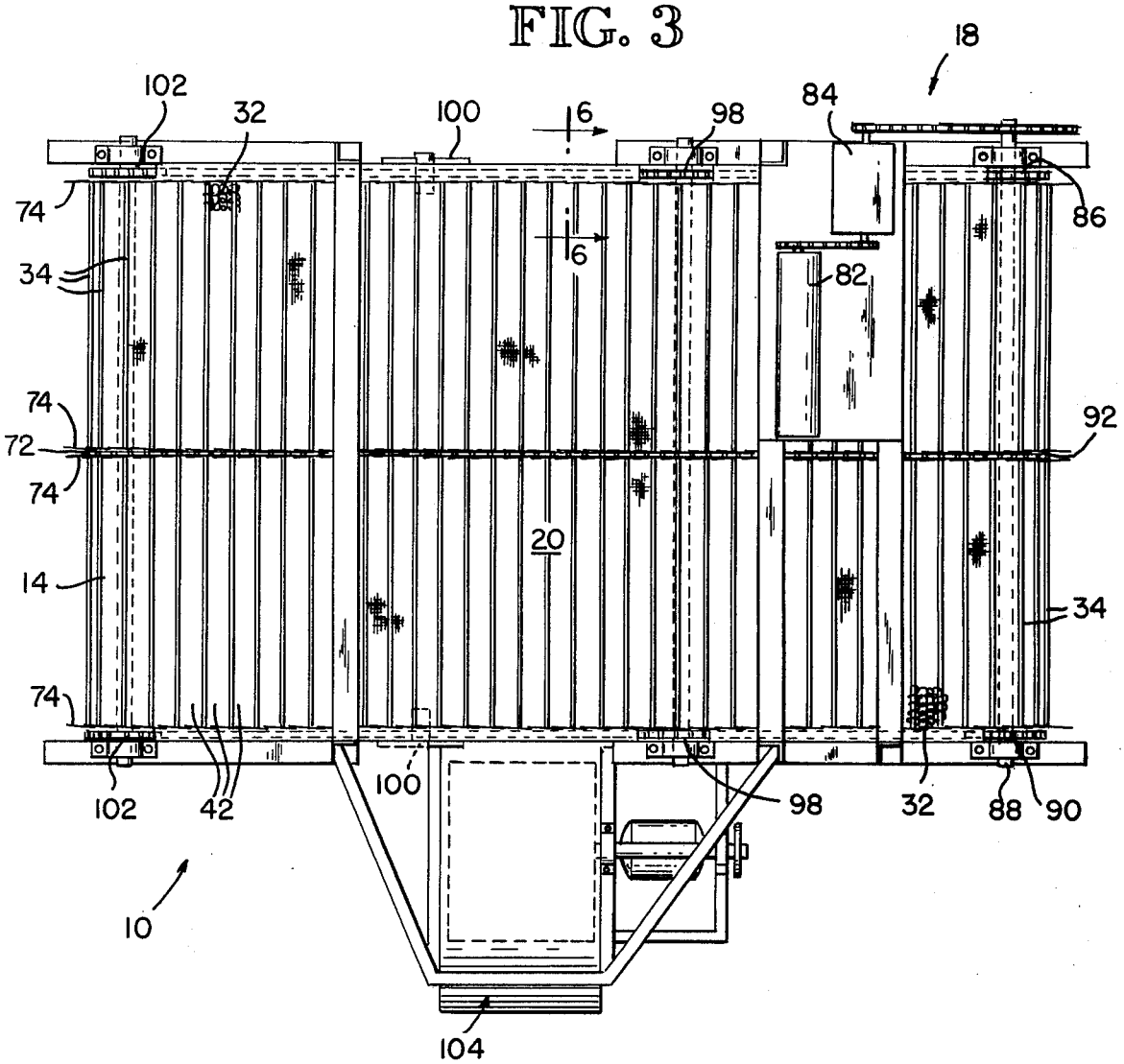
FIG. 3 is a top plan view of the apparatus shown in FIG. 1.
Figure 4:
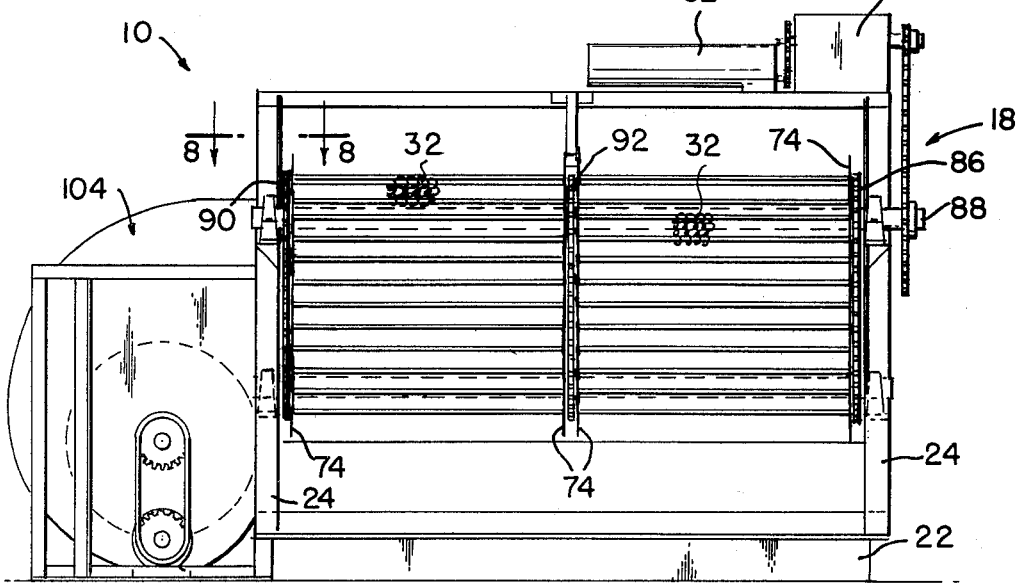
FIG. 4 is an end elevational view of the apparatus of FIG. 3, looking from the right.

Drive means 18 provides the motive force for movement of the belt 14 about its closed path of travel. Drive means 18 is preferably comprised of a variable speed motor or engine 82 in operative engagement with a gear reduction box 84 which reduces the speed of the motor and steps up its torque. The output of the gear reduction box 84 is applied to a first drive sprocket 86, best viewed in FIG. 3, which is borne upon an axle 88 coupling it to a second drive sprocket 90 at the other edge of the apparatus. In the most preferred embodiment, where the intermediate drive chain 72 is included, yet a third drive sprocket 92, best viewed in FIGS. 2 and 3, is also secured on the drive shaft or axle 88. Thus, the three drive sprockets 86, 90 and 92 are coupled for uniform rotation when driven by the drive means 18. Each of the sprockets, as is conventional, includes a central disk or hub with a series of peripheral drive teeth, such as the teeth 94 on sprocket 92 as shown in detail in FIG. 2. The teeth 94 are configured to mate with the gaps in each of the links 64 so that the riffle members 34 are received in the recessed areas 96 separating the teeth.

An array of idler or guide sprockets identified generally as 98, 100, and 102 are also included to guide the belt 14 about its closed, generally trapazoidally-shaped path. Each set of idler sprockets includes individual sprocket members for engagement with the drive chains, and the sprockets comprising each set are most preferably secured for rotation about a common drive shaft or axle as generally shown in FIG. 3. Accordingly, when the drive means 18 is energized, it will drive the three sprockets 86, 90, and 92 in unison in order to provide movement to the belt 14 in the direction of the arrow in FIG. 5, while the belt is supported and guided along its closed path about the array of idler sprockets 98, 100, and 102. It is highly preferred that the drive means 18 be adjustable so that the speed of travel of the belt about this path may be regulated. While the optimum speed for separation is dictated by quite a number of factors, including the angle of inclination of the segment 20 and the condition of the feed, the ability to adjust the speed of travel of belt 14 over the range of from about 0.2 inches per minute to about 6 inches per minute has been found most advantageous.

Fluidizing gas, most conveniently ambient air, is caused to pass upwardly from the fluidizing chamber through the belt 14. A variable speed fan 104 is included within the apparatus 10 in order to provide the fluidizing air to the chamber or plenum 16. The fan member 104 may be of any conventional design and forms no part of the present invention, however it is important that the fan selected be one which has sufficient flow capabilities to provide a static pressure head of at least about 10 psig within the plenum 16. Generally, a static pressure head averaging about 6–6.5 psig is found to be adequate for most situations, but this added capacity may be necessary or desirable under certain circumstances. The air flow from fan 104 is directed into the plenum chamber 16 through a duct 106. Both the duct and the interior of the plenum 16 include a series or array of baffle plates or deflectors 108, some of which are shown in FIG. 1, in order to distribute the flow of fluidizing air uniformly throughout the plenum so that the air directed upwardly through the screen member 60 and thence through the belt 14 is substantially uniform along and across the inclined segment 20.

As the fluidizing air passes upwardly through the belt 14 it both fluidizes the gravel and establishes an electrostatic charge or potential proximate the belt 14 which serves to attract and retain the metallic constituents. This naturally-occurring electrostatic charge will be found under most circumstances to be very efficient in providing the desired separation and retention effects. However, depending upon the condition of the charge or the ambient, particularly with reference to moisture or humidity content, it may be found necessary or desirable to augment that naturally-occurring electrostatic potential. For that purpose, an auxiliary electrostatic charge generator 110 of conventional design, is associated with the plenum 16. A generator known as sold by Binks Model 111-1091 charge transformer has been found to be quite satisfactory; although any other equivalent device might equally well be employed. The charge generator will impart a static charge on the belt, transmitted thereto by the fluidization air.

In operation, the mining apparatus 10 of the present invention is very efficient and simple to use. The device may be easily transported to remote locations where the dry placer mining operation is to occur and may be set in place on the ground, supported on plate 22, or may be retained on the vehicle used to transport the device. In either event, the frame 24 is tilted to the desired angle of inclination by means of the hydraulic cylinders 30 and the belt is set in motion by means of the drive 18. With the belt moving in the direction shown by the arrow in FIG. 5, screened gravel, preferably having an average size of less than $\frac{1}{4}''$, is conveyed to a hopper 112 by, e.g., a belt 114. The hopper distributes the gravel mix near the upper end of the inclined path 20 uniformly across the belt 14. The fan 104 simultaneously provides fluidization gas through the belt as it moves with the gravel charge thereon.

As the belt moves, gravel is fluidized by means of the upwardly directed pressurized air flowing through it which classifies the lighter components from the more dense "dark" sands and metallic constituents. The fluidized portion of the gravel falls by gravity just above the upper surface of the mesh web 32, as shown diagrammatically in FIG. 7. As the gravel tumbles over the riffles, the air causes a turbulent flow of gravel which follows a somewhat elliptical or oval path. All of this activity, with air passing through the composite fabric 36, creates an electrostatic potential or charge imbalance proximate the belt 14. This electrostatic potential will have little or no effect on the gravel but will result in an attraction and retention of metallic constituent proximate the belt 14. More particularly, it is found that the metallic constituents tend to congregate at the upstream side of the riffles 34 and, more particularly, on the underside of the curved surface thereof such as is indicated at A in FIG. 7; which, by virtue of the curved profile and underlying fabric, provides a closed collection space trapping the retained material. As the belt 14 continues its upward travel, with the separated or concentrated metallic constituents retained thereon along with dark sands, the gravel which has had these metallic constituents removed falls from the bottom of the device as tailings. When the belt reaches the uppermost part of the path 20 and begins its downward descent, the metallic constituents and dense particulate will tend to be dislodged, as shown diagrammatically in FIG. 5, and be deposited on a moving conveyor 116 which discharges these concentrates to a pan or container 118. Depending on the ambient conditions, it sometimes occurs that the residual electrostatic potential on the belt 14 retains the metallic particles even during this downward descent and that not all of the particles are dislodged for collection. Accordingly, it is generally advantageous to include a "bump bar" or small magnetic vibrator at or near the point where the belt first leaves the drive sprocket array region to bump or vibrate the belt and assist in the dislodgement of the particulate.

The recovered product is found to be highly concentrated in metallic content as opposed to the initial charge through hopper 112. Testing of the apparatus 10 has shown that recoveries in excess of 90% may be realized under even very adverse conditions where the tests were conducted on relatively damp or even slightly moist material. Under optimum conditions, where both the charge is dry (less than about 10% water content) and the ambient at a relatively low humidity, recoveries in excess of 97% are customary and recoveries of 99% are not all unusual. With the initial gravel mix concentrated to such a substantial degree, it may be transported for further refining more efficiently and more economically.

As can be seen from the foregoing detailed description of preferred embodiments, the apparatus 10 is a simple yet highly efficient device for the concentration of valuable metallic constituents from a gravel mix comprising same. The entire operation may be easily conducted on a continuous basis, thus eliminating the need to shut down the device for recovery. Furthermore, the entire operation may be conducted by a single individual who can also move the apparatus from location to location rather than be required to haul the unprocessed gravel over considerable distances.

While the invention has now been described with reference to these preferred embodiments, those skilled in the art will appreciate that various substitutions, changes, modifications and omissions may be made without departing from the spirit thereof. Accordingly, it is intended that the scope of the present invention be limited solely by that of the claims granted herein.

What is claimed is:

1. Apparatus for dry placer mining to concentrate metallic constituents from a gravel mix comprising same, said apparatus comprising:

a. a frame for supporting and guiding an endless separation belt along a closed path including an upwardly inclined segment for receiving a gravel mix containing a low concentration of metallic constituents;

b. endless separation belt means, including:

(i) a woven mesh belt member having raised loop elements and transversely extending interstices;

(ii) a plurality of riffle members disposed in spaced, generally parallel relationship through selected ones of said interstices; and, (iii) a composite fabric member secured to the underside of said mesh belt, comprising a layer of air-pervious polymeric foam disposed intermediate upper and lower layers of cloth fabric; and, c. fluidizing means for passing a fluidizing gas upwardly through said separation belt substantially uniformly along and about said upwardly inclined segment to fluidize said gravel mix and concomitantly establish an electrostatic charge proximate said separation belt; wherein the combined fluidization of gravel and electrostatic charge effectuate a substantial separation of said metallic constituents from said mix and retention of the former proximate said riffles thereby concentrating the metallic constituents for recovery.

2. The apparatus of claim 1, further including first and second drive chain means integral with said separation belt, said drive chain means comprising a series of links joining the terminal ends of successive riffles together, wherein each link is comprised of first and second terminal connecting bars in spaced relationship spanning adjacent riffles and a roller member on each of said riffles disposed intermediate said terminal bars to yield a link gap bounded transversely by said terminal bars and longitudinally by successive roller members.

3. The apparatus of claim 2, further including third drive chain means integral with said separation belt intermediate the width thereof, said third drive chain means comprising a series of links joining successive riffles together intermediate the length thereof, wherein each of said links is comprised of first and second intermediate connecting bars in spaced relationship spanning adjacent riffles and a roller member on each of said riffles disposed intermediate said intermediate bars to yield a link gap bounded transversely by said intermediate bars and longitudinally by successive roller members.

4. The apparatus of claim 3, wherein said mesh belt is comprised of first and second mesh belt segments, the first extending between said first and said third drive chain means and the second extending between said second and said third drive chain means.

5. The apparatus of claims 2, 3 or 4 further comprising drive sprocket means disposed proximate the upper end of said inclined segment for driving engagement with said drive chain means and idler sprocket means disposed along said path in operative engagement with said frame for guiding said separation belt, wherein the teeth of each of said sprocket means are configured for mating engagement with said links.

6. The apparatus of claim 5, further comprising guard means for confining the flow of gravel substantially along said inclined path, said guard means comprising a series of partially overlapping, upstanding guard plates, each of said plates being secured at its lower end to two successive riffles proximate the edges of the mesh belt.

7. The apparatus of claim 5, wherein said fluidizing means comprises a plenum secured to said frame interiorly of said path, having an inlet for receiving a flow of fluidizing gas, an outlet for discharging said gas to said separation belt, and baffles means for providing a substantially uniform distribution of said gas along and about said inclined segment.

8. The apparatus of claim 7, further comprising a screen disposed intermediate said outlet and said separation belt.

9. The apparatus of claim 7, further comprising an auxiliary electrostatic charge generator for augmenting said electrostatic charge developed during fluidization.

10. The apparatus of claim 9, wherein said generator is disposed in operative communication with said separation belt.

11. The apparatus of claim 7, further comprising a base and incline adjustment means securing said frame thereto, for regulating the angle of inclination of said inclined segment.

12. The apparatus of claim 11, wherein said incline adjustment means is comprised of hydraulic cylinder means.

13. The apparatus of claim 5, further comprising drive means including a speed controlled motor.

14. Apparatus for dry placer mining comprising:

a. a pivotal frame for supporting and guiding an endless separation belt along a closed path including a gravel receiving and fluidization segment;

b. an endless separation belt consisting essentially of first and second endless woven mesh segments disposed side by side, each of which webs includes raised loops defining closed transverse channels of interstices, a series of riffles disposed in spaced, parallel relationship through certain of said channels to yield transverse collection zones separated and bounded by adjacent riffles, and a composite fabric backing of a layer of air-pervious polymeric foam disposed intermediate upper and lower cloth fabric layers comprised of synthetic fibers;

c. integral drive chains formed in said belt at either edge and intermediate the location of said first and second woven mesh web segments, each of said chains including a series of links comprised of first and second connecting bars joining two successive riffles and a roller member disposed between said connecting bars;

d. guard means confining the path of gravel to one along said receiving and fluidizing segment, said guard means comprising an upstanding, peripheral row of a plurality of guard plates disposed proximate each edge of said mesh web segments wherein each of said guard plates spans two successive riffles; and, e. fluidizing means for fluidizing gravel particulate conveyed upon said separation belt through said fluidization segment.

15. The apparatus of claim 14, wherein said fluidizing means comprises a plenum disposed interiorly of said path, for delivering fluidizing air through said gravel receiving and fluidizing segment and fan means for charging said plenum.

16. The apparatus of claim 15, wherein said composite fabric is comprised of a bottom layer of an open weave polyester fiber batting, an intermediate layer of foamed polyester, and a top layer of a close weave polyester-cotton fiber blend fabric.

17. The apparatus of claims 14, 15 or 16, further comprising drive means for moving said separation belt along said path, said drive means including a variable speed drive motor in operative engagement with an array of drive sprockets disposed proximate the upstream end of said gravel receiving and fluidizing segment, wherein said array of drive sprockets is comprised of axle means joining first, second and third drive sprockets, one of each being in engagement with a respective one of said integral drive chains, and a plurality of arrays of idler guide sprockets disposed about said path, each of said arrays of guide sprockets including axle means joining first, second and third idler guide sprockets in engagement with a respective one of said integral drive chains.

18. The apparatus of claim 17, further comprising an electrostatic charge generator in operative communication with said separation belt for establishing an electrostatic charge thereon.

* * * * *